United States Patent [19]

Bain

[11] 4,221,441

[45] Sep. 9, 1980

[54] PREFABRICATED KITCHEN-BATH UTILITY SYSTEM

[76] Inventor: William J. Bain, 1540 Parkside Dr. E., Seattle, Wash. 98102

[21] Appl. No.: 28,572

[22] Filed: Apr. 9, 1979

[51] Int. Cl.[2] ..... E04H 1/02; A47C 17/38

[52] U.S. Cl. ..... 312/228; 52/36; 52/79.1; 312/237

[58] Field of Search ..... 312/209, 228, 229, 237, 312/278, 279; 52/36, 79.1, 173

[56] References Cited

U.S. PATENT DOCUMENTS

| | | | |
|---|---|---|---|
| 2,419,319 | 4/1947 | Lankton | 52/79.1 |
| 2,550,539 | 4/1951 | Earle | 312/228 |
| 3,862,534 | 1/1975 | Coletti | 52/79.1 |
| 3,992,848 | 11/1976 | Stucky | 52/79.1 |

*Primary Examiner*—Casmir A. Nunberg
*Attorney, Agent, or Firm*—Seed, Berry, Vernon & Baynham

[57] ABSTRACT

A modular prefabricated kitchen/bath/utility system is disclosed for home or apartment installation. The system is provided with all utility services and may be built in three sections or modules for ease of transportation and introduction into a building or built as a single section. A first module is made up of two open-ended, back-to-back units, one unit supporting a range/oven unit, adjacent under-counter storage and overhead cabinet storage and the other back-to-back unit incorporating a space heating unit and a hot water heating unit. A second module adapted to fit adjacent the first module incorporates space for a refrigerator, under-counter cabinet storage and overhead cabinet storage with a counter and sink unit covering the under-counter cabinet storage units. A third module fits back-to-back against the second module and includes a one-piece molded tub/shower unit, an adjacent lavatory unit and a water closet. Wastewater drainage and water supply means are located in a space between the back wall of the third module and the back wall of the second module. The wastewater drainage system is operatively connected to the tub/shower unit, lavatory, kitchen sink and water closet. The water supply connections are also made so that, when the unit is installed, it can be quickly connected to existing sewer and water supplies. Access to the utility space is provided through a panel behind the water closet.

4 Claims, 7 Drawing Figures

PREFABRICATED KITCHEN-BATH UTILITY SYSTEM

BACKGROUND OF THE INVENTION

1. Field of the Invention

This invention relates to a prefabricated modular system incorporating a kitchen unit, a bath unit and a utility unit.

2. Prior Art Relating to the Disclosure

Modular units for incorporation in new or existing home and apartment construction are known. Due to the rising cost of home construction, such prefabricated modular systems are becoming more prevalent. Many of the systems which are presently used, however, are not provided with connected utilities so that they may be readily installed to existing sewer and/or water services.

SUMMARY OF THE INVENTION

It is an object of this invention to provide a modular prefabricated kitchen/bath/utility system which is asthetically pleasing and economically attractive.

It is another object of the invention to provide a modular prefabricated system which can be transported as three separate modules, each of which is of a size to be introduced into an existing building.

It is a further object of this invention to provide a modular prefabricated system wherein the wastewater drainage lines and water supply lines are incorporated within one of the modules for ready connection to all of the fixtures incorporated in the system.

It is a further object of this invention to provide a modular prefabricated system wherein access to the utility lines for service and/or maintenance is readily provided.

It is a further object of this invention to provide a prefabricated system which is attractive and can be provided and installed in residential housing at considerable cost savings.

These and other objects are accomplished with a three module kitchen/bath/utility system. The first or utility module is made up of two, open-ended, back-to-back units, one unit of which supports a range/oven unit and adjacent under-the-counter cabinet storage as well as overhead cabinet storage. The other unit supports a hot water heating unit and a space heating unit. The second or kitchen module adapted to be connected to the first module incorporates overhead cabinet storage and under-the-counter cabinet storage, a kitchen sink whose drain is connected to a garbage grinder unit, a dishwasher unit, space for a refrigerator unit and a cleanout for drain lines. The third or bath module is adapted to fit back-to-back against the second module and incorporates a one-piece molded tub/shower unit, an adjacent lavatory unit and a water closet. The back walls of the second and third modules include a jog therein to provide extra depth for the tub/shower unit. A wall forward of the back wall of the third module provides a utility space immediately behind the wall for wastewater lines and water supply lines for each of the fixtures mentioned. Access to the utility space is through a panel immediately behind the water closet.

DETAILED DESCRIPTION OF THE INVENTION

Figure 2:
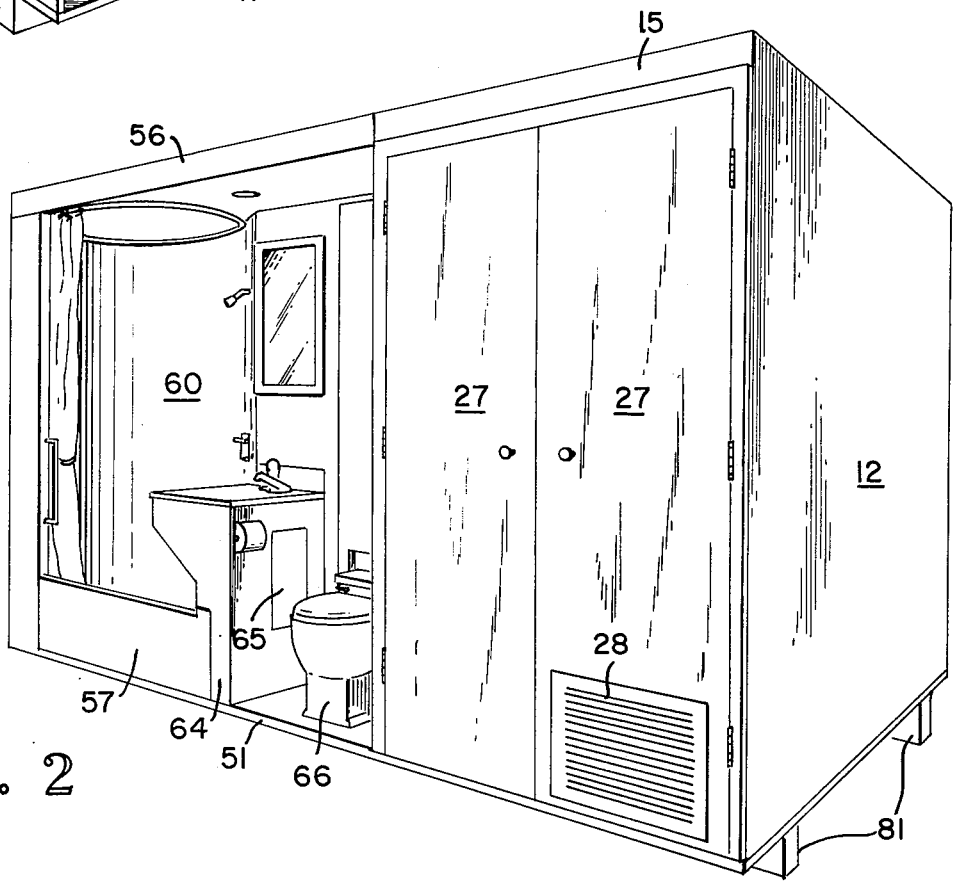
FIG. 2 is a perspective view of the bath/utility unit which is designed to fit back-to-back against the kitchen unit.
Figure 6:
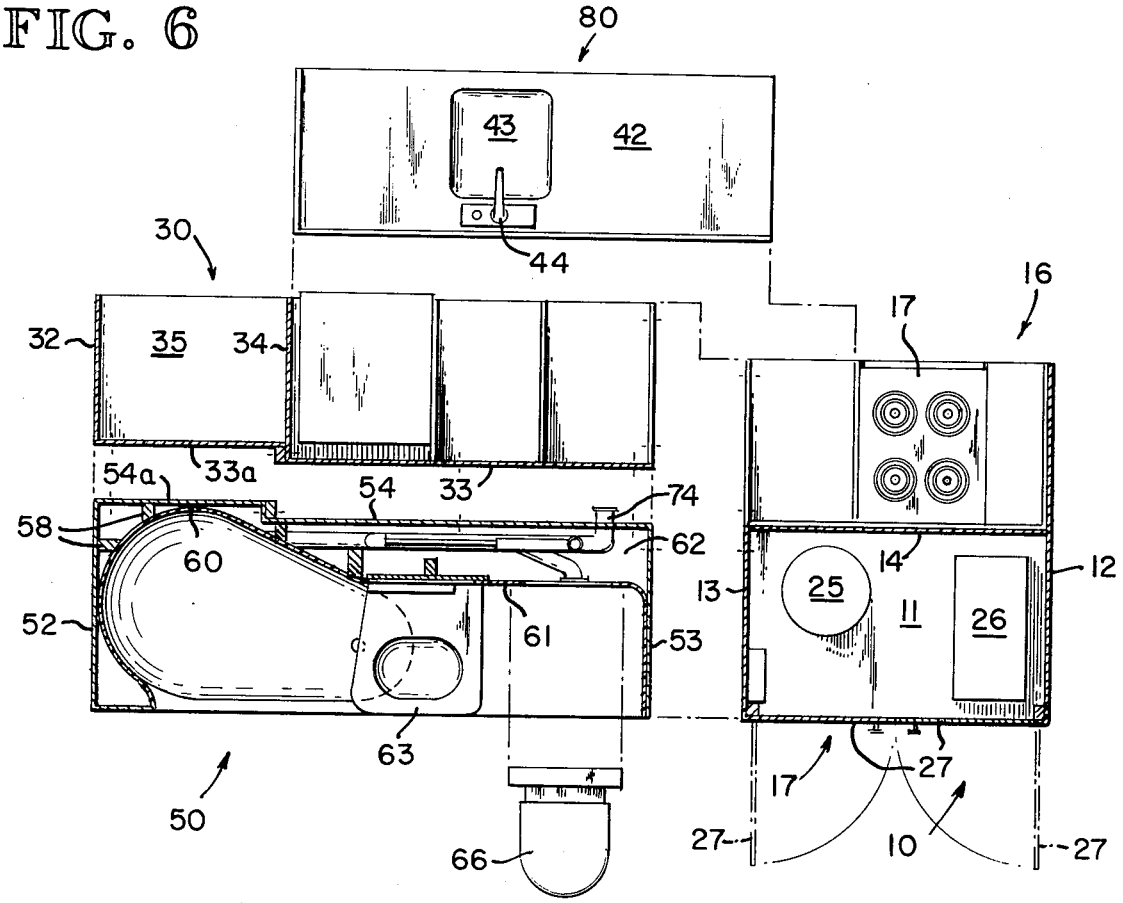
FIG. 6 is a horizontal sectional exploded view of the system illustrating how the three separate modules are joined together during installation.

Referring to FIG. 6, the system described and claimed is composed of three separate modules and a countertop portion although the unit may be built as a single unit. Each module is sized for ease of transportation and introduction into existing buildings or for new construction. Referring to FIG. 6, the three modules include a utility unit 10, a kitchen unit 30, a bath unit 50 incorporating utility lines serving the kitchen unit and utility unit and a countertop portion 80. Each of the modules has a frame constructed from any suitable building materials such as ½" to ¾" plywood sheets reinforced by suitable stud supports where needed, the frame assembled together in the form of open-ended rectangular boxes. The floor of each module, supported on spaced floor joists 81 as illustrated in FIG. 2, may employ plywood laminates of greater thickness, such as 1⅛".

Figure 4:
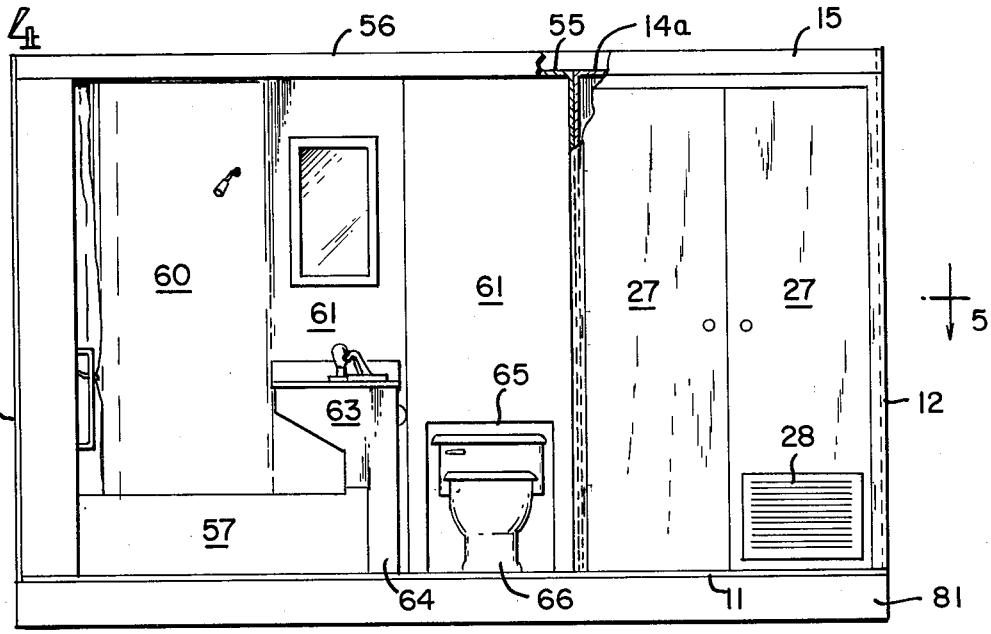
FIG. 4 is a plan view of the bath/utility unit.

The utility module 10 includes a lower supporting floor 11 of one or several sheets of plywood sandwiched together and connected to parallel sidewalls 12 and 13. The module is divided into two, separate, back-to-back, open-ended compartments by a common back wall 14. An upper wall **14*a* (see FIG. 4) connects the two sidewalls and is provided on its forward edge with a facia board 15. The open-ended compartment 16 is made to a depth sufficient to receive standard size range/oven units, generally about 26 inches in depth. The other compartment 17 is of greater depth. The compartment 16 is adapted to receive a range/oven unit 17 as illustrated. Adjacent under-the-counter cabinet storage units 18 and 19 are provided on each side of the range/oven unit. A countertop 20 is provided for the top of the cabinet storage unit 18 interposed between the sidewall 12 and the range/oven unit 17. The countertop for the cabinet storage unit 19** is provided as a single continuous piece and overlaps with the kitchen module as will be described.

Figure 1:
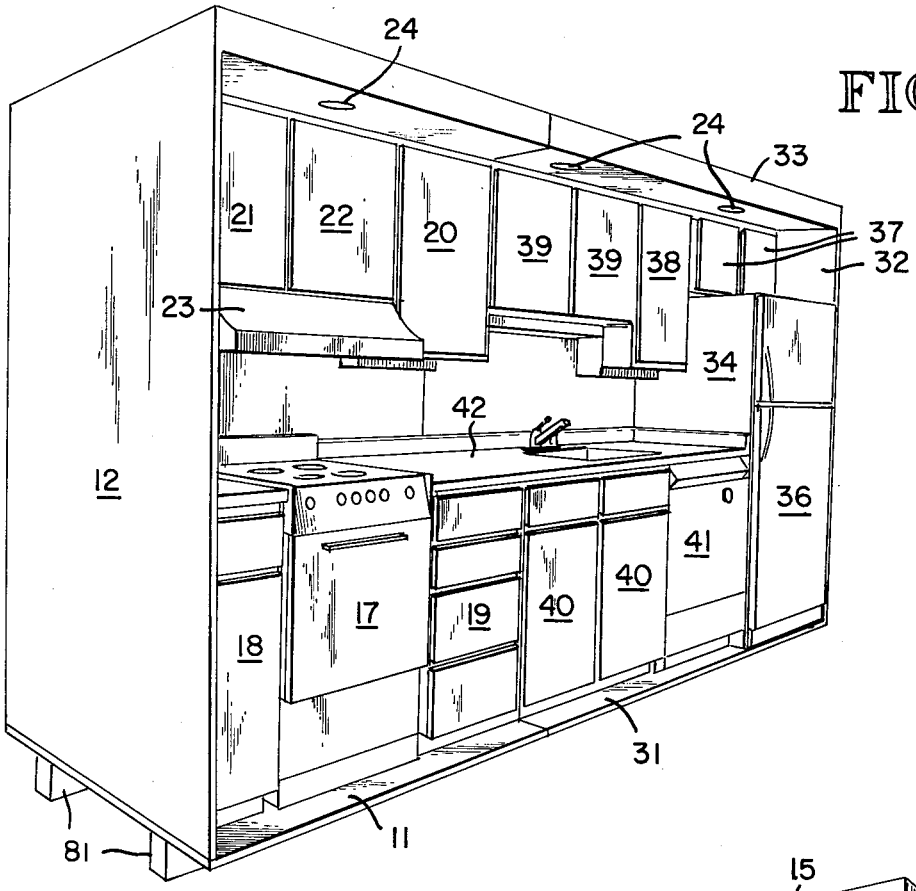
FIG. 1 is a perspective view of the kitchen unit.

Overhead cabinet storage units 20, 21 and 22 are provided as well as a hood 23 incorporating an exhaust fan and duct system (not shown). Recessed lighting 24 is also provided (see FIG. 1).

The compartment 11 contains a hot water heating unit 25 and a space heating unit 26, such as a gas, oil or electric furnace whose air outlet duct extends through the top wall **14*a* of the module for connection to ducts supplying heated air to other parts of the dwelling unit. The compartment 11 is closed by a pair of doors 27 hinged conventionally. One of the doors is provided with a louvered portion 28** providing an air intake for the furnace.

The second module is a kitchen module 30. The module is enclosed in a prefabricated rectangular box unit made of ½" to ¾" plywood sheeting reinforced by necessary studding and includes a lower floor support member 31 connecting with a sidewall 32 and back wall 33. A top wall (not shown) covers the unit. As is true with the utility unit 10, a facia board 33 extends the full length of the forward edge of the upper part of the module. If desired, a separating wall 34 may be provided to delineate a compartment 35 sized to receive a refrigerator unit 36. Overhead cabinet storage units 37, secured to the upper back and side walls of the module, are positioned above the refrigerator unit 36. Additional overhead cabinet storage units 38 and 39 may be provided above the kitchen sink, these units also secured to the frame of the module. Under-the-counter cabinet storage units 40 beneath the kitchen sink may be provided as well as an under-the-counter dishwasher unit 41.

A one-piece countertop 42 spans the distance between the wall 34 and the range/oven unit 17 as illustrated in FIG. 6. The countertop, which may be covered with Formica or other suitable covering, includes a kitchen sink unit 43 provided with a water supply 44. Connected to the drain of the sink is a garbage disposal unit (not shown). The back wall 33 of the module may include one or more electric receptacles and switches for activation of the garbage disposal unit and provide power to countertop appliances such as mixers, can-openers, etc.

Figure 5:
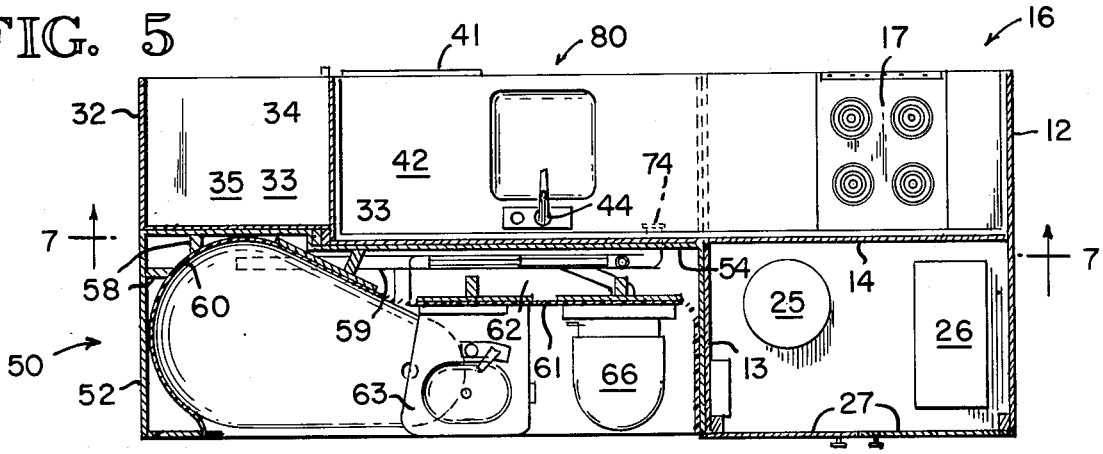
FIG. 5 is a horizontal sectional view along section line 5—5 of FIG. 4 illustrating how the three modules are joined together into a single system.

The third or bath module 50 is enclosed within a frame structure formed by a floor 51, sidewalls 52, 53, a back wall 54, and a top wall 55. A facia board 56 is provided at the forward edge of the module as illustrated in FIG. 5. It is to be noted that the back wall 54 includes a portion 54*a* of greater depth than the remainder of the wall. This complements the wall portion 33*a* of the second module which is of lesser depth than the remainder of the module. This jog in the two common walls accommodates the greater depth needed for the tub/shower unit placed in the bath module. The tub/-shower unit 57 is a one-piece molded unit of resin reinforced glass fiber construction as illustrated. The unit is supported in place in the frame structure of the module by suitable spacers 58 and support member 59. The rear wall 60 of the tub/shower unit merges with a forward wall 61 spaced forward of the wall 54 of the unit as illustrated by FIGS. 5 and 6. The compartment 62 between the wall 61 and rear wall 54 holds the utility connections for the fixtures of the system. The wall 61 merges with the sidewall 53 as illustrated in FIGS. 5 and 6. A lavatory unit 63 having a offset floor support 64 as illustrated is provided adjacent the tub/shower unit. An access panel 65 (See FIG. 2) is provided for access to service and/or maintain the water supply and drain system of the lavatory unit. Access to the space 62 is provided through a panel 66 behind the water closet 67.

Figure 3:
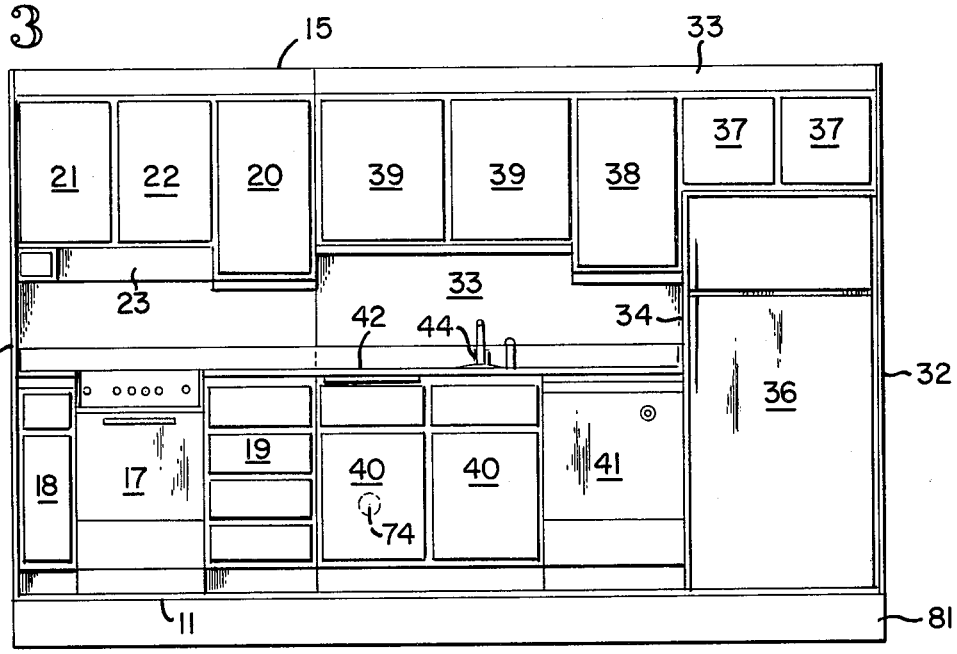
FIG. 3 is a plan view of the kitchen unit.
Figure 7:
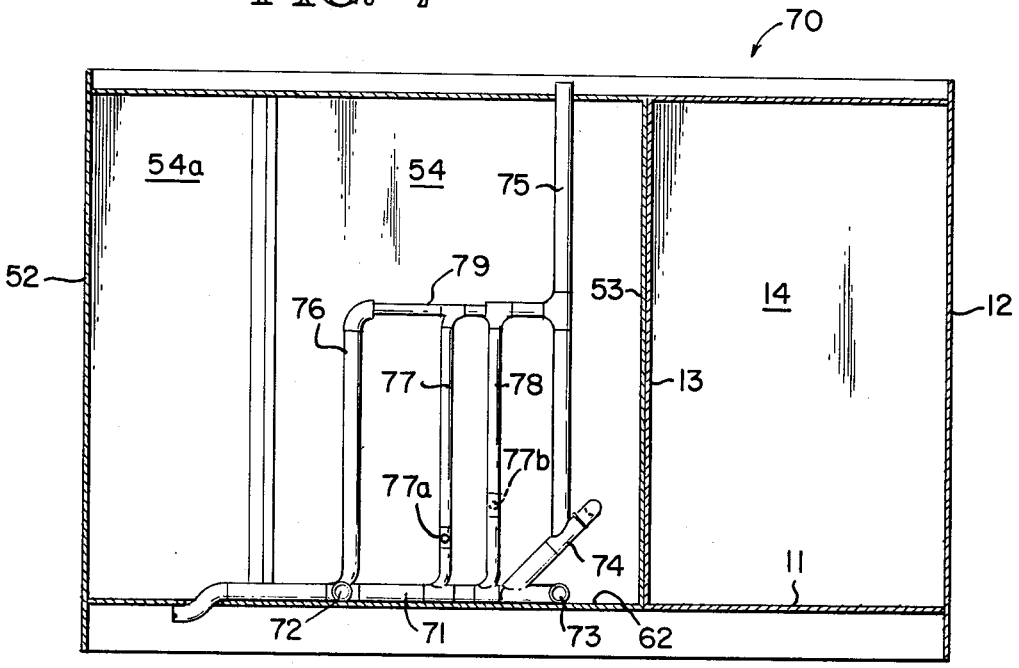
FIG. 7 is a view of the drainage means provided with the bath module for easy connection to existing service facilities and to the kitchen module.

FIG. 7 illustrates the wastewater drain and vent system for the three module system. A main drain 71 has a T connection 72 which connects with the drain of the tub/shower unit and an L connection 73 which connects with the toilet. A cleanout line 74 also connects to the main drain 71 and extends through the back wall 54 of the module and the back wall 33 of the adjacent module. The line 71 is thus available for cleanout by access to the cleanout line beneath the cabinet and sink of module 30 as illustrated in FIG. 3. A vent pipe 75 connects with the cleanout line 74 as illustrated. Additional vent pipes 76, 77 and 78 as required by code all connect with the main vent pipe 75 through a common line 79. The main drain line may exit through the floor at any desired point for connection to existing sewer lines. T connections 77*a* and 77*b* connect respectively to the drain of the lavatory unit and kitchen sink. Water supply lines are also provided in the utility compartment 62 to provide water to the lavatory unit, tub/-shower unit, water closet and kitchen sink.

I claim:

1. A prefabricated modular kitchen/bath/utility system ready for installation, the system provided with all utility services, comprising:

a first module made up of two back-to-back units, each unit having a lower supporting floor, sidewalls and a common back wall, one of the units supporting a range/oven and adjacent under-the-counter cabinet storage and overhead cabinet storage, the other unit including a hot water heating unit and a space heating unit covered by a pair of doors closing the open end of the module, a second open-ended module having a lower supporting floor, back wall and parallel sidewalls with one sidewall adapted to abut the under-the-counter cabinet storage unit of the first module, the second module including space for a refrigerator unit and overhead cabinet storage, a dishwasher unit and under-the-counter cabinet storage, a finished countertop including a sink unit covering the under-the counter cabinet storage unit of the first and second modules, a third open-ended module adapted to fit back-to-back against the second module, the third module having a lower supporting floor, back wall and parallel sidewalls, an additional wall positioned forward and substantially parallel to the back wall forming a compartment between the additional wall and back wall of the module for utility services, the third module including a one-piece molded tub/shower unit, an adjacent lavatory unit whose upper portion overlaps the rim of the tub/-shower unit and a water closet, and wastewater drainage and vent means located in the compartment of the third module, the wastewater drainage and vent means operatively connectable to the tub/shower unit, lavatory unit, kitchen sink and water closet.

2. The system of claim 1 wherein the back wall of the third module has a jog therein to form a portion of greater depth than the remainder of the module for receiving the tub/shower unit, and wherein the back wall of the second modules abutting the jogged portion of the back wall of the third module includes a corresponding jogged portion forming a portion of lesser depth than the depth of the remainder of the unit of the module receiving the refrigerator unit.

3. The system of claim 1, wherein access to the wastewater drainage and vent means is through an opening in the additional wall of the third module, the opening covered by the water closet.

4. The system of claim 1 wherein the wastewater drainage means includes a common drain line connecting with the drain of the kitchen sink, tub/shower unit, lavatory unit and water closet, vent pipes extending vertically from the common drain line and a cleanout for the drain line extending through the back wall of the second and third modules, with access to the drain line being beneath the kitchen sink.

* * * * *